US008869847B2

(12) United States Patent
Browne-Wilkinson

(10) Patent No.: US 8,869,847 B2
(45) Date of Patent: Oct. 28, 2014

(54) BEVERAGE LIQUID DISPENSING DEVICE

(76) Inventor: Oliver Browne-Wilkinson, Bristol (GB)

( * ) Notice: Subject to any disclaimer, the term of this patent is extended or adjusted under 35 U.S.C. 154(b) by 623 days.

(21) Appl. No.: 12/518,726

(22) PCT Filed: Dec. 11, 2007

(86) PCT No.: PCT/GB2007/050749

§ 371 (c)(1),
(2), (4) Date: Jun. 11, 2009

(87) PCT Pub. No.: WO2008/072012

PCT Pub. Date: Jun. 19, 2008

(65) Prior Publication Data

US 2009/0266443 A1 Oct. 29, 2009

(30) Foreign Application Priority Data

Dec. 11, 2006 (GB) ..... 0624650.8

(51) Int. Cl.

| | |
|---|---|
| ***B65B 1/04*** | (2006.01) |
| ***B65D 5/72*** | (2006.01) |
| ***B67D 1/12*** | (2006.01) |
| ***B67D 1/14*** | (2006.01) |
| ***B67D 1/08*** | (2006.01) |
| ***B67D 1/00*** | (2006.01) |

(52) U.S. Cl.

CPC ..... *B67D 1/1405* (2013.01); *B67D 1/1238* (2013.01); *B67D 1/1411* (2013.01); *B67D 1/0888* (2013.01); *B67D 1/0085* (2013.01)

USPC ..... 141/392; 222/567

(58) Field of Classification Search

USPC ..... 141/392; 222/513, 527, 567

See application file for complete search history.

(56) References Cited

U.S. PATENT DOCUMENTS

| | | | | | |
|---|---|---|---|---|---|
| 2,006,194 | A | * | 6/1935 | Bertschinger | 222/88 |
| 3,215,318 | A | * | 11/1965 | Riha et al. | 222/183 |
| 4,131,218 | A | * | 12/1978 | Tatsuno | 222/527 |
| 4,905,743 | A | | 3/1990 | Gray | |
| 5,058,783 | A | * | 10/1991 | Antonelli | 222/538 |
| 5,097,994 | A | * | 3/1992 | Washam | 222/527 |
| 5,251,820 | A | * | 10/1993 | Ho | 239/280.5 |
| 5,515,893 | A | * | 5/1996 | Donohue | 141/392 |
| 5,890,631 | A | * | 4/1999 | Spurlock et al. | 222/538 |
| 6,047,866 | A | * | 4/2000 | Brown | 222/608 |
| 6,244,477 | B1 | * | 6/2001 | Hudelmaier | 222/527 |
| 7,387,222 | B2 | * | 6/2008 | Thompson et al. | 222/527 |
| 7,389,947 | B2 | * | 6/2008 | Denton | 239/333 |

OTHER PUBLICATIONS

International Search Report for PCT/GB2007/050749, consists of 4 unnumbered pages, Aug. 11, 2008.

* cited by examiner

*Primary Examiner* — Timothy L Maust

(57) ABSTRACT

There is provided a liquid dispensing fitment for fitting to a dispensing tap for appropriately directing a flow of liquid from the dispensing tap. The dispensing fitment comprises a flexible tube, a non-elastic adjustment element operatively coupled to the flexible tube to place the flexible tube in a curved position. A locking element holds the non-elastic adjustment element in a position such that the flexible tube is held in a curved position in which liquid is dispensed from an end portion of the flexible tube in a required direction. The length of the non-elastic adjustment element can be varied by locking a required length of the non-elastic adjustment element relative to the flexible tube in order to vary the angle of curvature of the flexible tube.

1 Claim, 8 Drawing Sheets

REPLACEMENT SHEET / PAGE

BEVERAGE LIQUID DISPENSING DEVICE

This invention relates to liquid dispensing devices and is concerned more particularly, but not exclusively, with devices for dispensing beer or other beverages in conjunction with existing beer taps and fonts.

It is known to dispense beer from a beer tap which is manually moved into an "on" position to initiate dispensing of beer into a glass, with the beer being pumped by an electric pump at an enhanced flow rate, and which is subsequently manually moved into an "off" position to stop dispensing of the beer into the glass. However such an arrangement does not allow for 'hands free' dispensing of beer in that the person dispensing the beer must remain in the vicinity of the tap to turn it off once the required quantity of beer has been dispensed.

It is an object of the invention to provide a novel liquid dispensing device that enables automatic turning off of the tap once the required quantity of liquid and/or foam has been dispensed.

It is an object of the invention to dispense liquid using a liquid dispensing fitment that has an adjustment mechanism to improve the quality of the dispensed liquid that is typically dependent on the condition of the liquid before dispensing and the environment in which the liquid is to be dispensed.

The liquid dispensing fitment mitigates the problems faced due to a 'hands free' dispensing arrangement not typically being able to accommodate for factors such as changes in beer temperature, or differences between beverages, that may affect the quality of the dispensed beer. The manual process takes these factors into account by the person dispensing the beer holding the glass in the required position to ensure that the quality of the dispensed beer is not impaired.

According to a first aspect of the present invention there is provided a liquid dispensing device for fitting to a dispensing tap, the device comprising a connector for fitting to the tap, a sensor for sensing the quantity of liquid dispensed from the tap on turning on of the tap, an operating arm for engaging the tap, and a controller for causing the operating arm to turn off the tap in response to an indication from the sensor that the required quantity of liquid has been dispensed from the tap.

Such a device is particularly applicable to the dispensing of beer and other drinks in a public bar as it allows substantially hands free operation after the bartender has initiated dispensing by opening of the tap, and therefore allows more flexible and faster service through multi-tasking by the bartender. Typically the bartender places a glass under the tap and turns it on, and the dispensing device then controls when the tap should be turned off once the required level of liquid or foam generated by liquid being dispensed has been poured. The dispensing device may be used in conjunction with a dispensing fitment to direct the beer into the glass at the required angle, enabling the bartender to deliver faster service and consistent measures while multi-tasking. The dispensing device is preferably adapted to be assembled on a font/tap interface so that it can be used for any font poured beverages, and to allow for use with different sized glasses. The dispensing device is preferably also adapted to allow the conventional head button to be used to inject gas to provide a head to the beer in the glass, and also to enable the beer in the glass to be topped up manually using the existing tap.

In a preferred embodiment the sensor incorporates a level detector that senses the level of liquid and/or foam in the glass and supplies a turn-off signal when the liquid and/or foam in the glass reaches a predetermined level. Furthermore spring means are preferably provided for biasing the operating arm into a position to turn off the tap. The spring means may comprise a tension spring connected between the operating arm and a frame fixed to the mounting block.

The controller may incorporate an electromagnet for holding the operating arm in a rest position when actuated by a holding signal and for releasing the operating arm to turn off the tap when the holding signal is removed. Furthermore the controller may incorporate an electronic control circuit for supplying the holding signal to hold the operating arm in the rest position and for removing the holding signal in response to an indication from the sensor that the required quantity of liquid has been dispensed from the tap. The required level of detection is an adjustable limit based on the quantity of liquid to be dispensed which can be set by the bar operator. The controller may further comprise a memory to store dispensed liquid data and is arranged to transmit the dispensed liquid data using a communication network.

In the preferred embodiment the operating arm has two end regions and is pivoted intermediate its end regions on a frame fixed to the connector such that one end region of the operating arm is pivoted to turn off the tap when the other end region of the operating arm is acted upon in the required direction. In a variation of this embodiment the frame comprises a plate that is rotatably coupled to the connector and comprises means to lock the orientation of the frame. The operating arm may have a crossbar extending transversely to the tap for pivoting the tap into its off position.

In a preferred implementation the dispensing device is adapted to be used constantly as a permanent fitting. However the operation of the dispensing device is preferably such that it can be switched off to return to normal working bar practice in which dispensing is effected manually if required. For example the pivot arm may be movable into an inoperative position to enable the tap to be moved manually into its off position during dispensing.

In a preferred embodiment the sensor is releasably attached to a sensor support base that is slidably engageable to a tube coupled to the connector. A container support may be rotationally coupled to the tube such that the container support can be rotated about its axis.

The liquid dispensing device may be removably connectable to the tap so that it can be connected to a conventional dispensing tap and can be easily removed when not required. Alternatively the dispensing device may be integrally formed with the font/tap.

According to a second aspect of the present invention there is provided a storage medium containing dispensed liquid data from a liquid dispensing device to enable the dispensed liquid data to be transferred to a remote location, the liquid dispensing device comprising a connector for fitting to a tap of the liquid dispensing device, a sensor for sensing the quantity of liquid dispensed from the tap on turning on of the tap, an operating arm for engaging the tap, and a controller for causing the operating arm to turn off the tap in response to an indication from the sensor that the required quantity of liquid has been dispensed from the tap.

According to a third aspect of the present invention there is provided a liquid dispensing fitment for fitting to a dispensing tap for appropriately directing a flow of liquid from the dispensing tap, the dispensing fitment comprising a flexible tube, an adjustment element operatively coupled to the flexible tube to place the tube in a curved position, and a locking element for holding the adjustment element in a position such that the tube is held in a curved position in which liquid is dispensed from an end portion of the tube in a required direction.

In a preferred embodiment the adjustment element is slidably coupled to at least one point on the tube.

In a preferred implementation the liquid dispensing fitment is arranged to be coupled to at least one point separate to the tube.

In a preferred embodiment the liquid dispensing fitment is provided with a release element to release the tube from the curved position.

Such a dispensing fitment is particularly applicable to the dispensing of beer and other drinks in a public bar as it provides substantial control over factors that typically affect the quality of the dispensed product, such as the beer flow rate, temperature change and the gas content of the beer liquid as it is dispensed.

A bartender would use the dispensing fitment by placing a glass under the tap and adjusting the dispensing fitment so that the liquid is dispensed into the glass in the required direction. For example, the dispensing fitment can be adjusted so as to press the tube against the glass to reduce the amount of foaming generated by the liquid being dispensed, or be straightened to increase foaming generated by the liquid being dispensed. Hence the quality of the beer is improved as the dispensing fitment breaks the fall of the beer as it is poured into the glass.

The dispensing fitment can be used in conjunction with a hands-free dispensing device. The dispensing fitment therefore mitigates the disadvantages associated with a hands-free arrangement not having the means to account for the quality of the beer being affected by environmental factors, as the dispensing fitment directs the beer into the glass at the required angle/height to avoid excessive foaming generated by the liquid being dispensed.

The dispensing fitment is preferably adapted to be fitted into, or onto, a tap nozzle so that it can be used for a wide variety of beverages dispensed using a font tap mechanism, and can be used to pour into different sized containers. It is possible to do this as the dispensing fitment may be provided as a long length of tube that can be trimmed to a suitable dispensing length for fonts with differing heights of drip trays. Once cut to the required length the dispensing fitment can be used to dispense into different drink containers such as a half-pint glass, a pint glass, or a pitcher, whilst requiring limited adjustment of the dispensing fitment.

In one embodiment easy adjustment of the dispensing fitment is achieved using an adjuster cord and tension release tube provided with the dispensing fitment. In a variation of this embodiment the dispensing fitment has a dispensing tube that fits into the end of a tap nozzle with a push fit and locking rings are located at the top end of the fitment to lock the adjuster cord in a tensioned position. In a further embodiment a securing ring is used to provide a fluid tight seal between the tube and tap nozzle. This will be particularly necessary when regular adjustment is required.

The dispensing fitment may be removably connectable to the tap so that it can be connected to a conventional dispensing tap and easily removed when cleaning is needed or use is not required.

In order that the invention may be more fully understood, a preferred embodiment of the dispensing device in accordance with the invention, for use in controlling the dispensing of beer from a tap, will now be described, by way of example, with reference to the accompanying drawings, in which.

Figure 4:
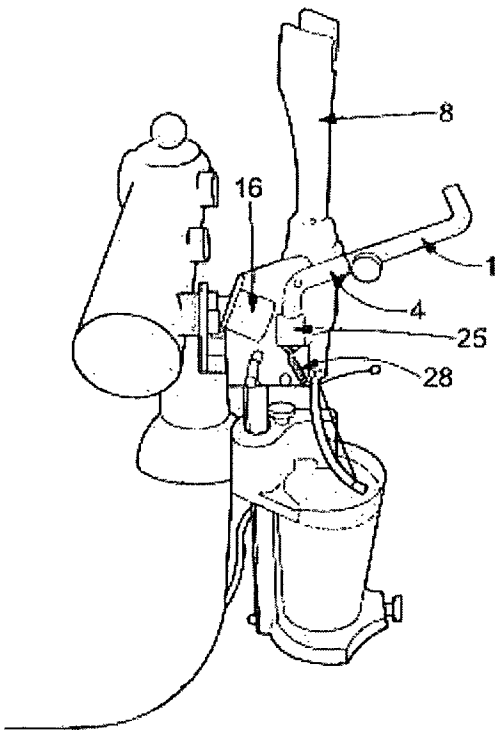
FIG. 4 is a side view with the tap in the 'off' position to stop filling of the glass with beer as result of spring tension acting to pivot the tap upwardly.
Figure 3:
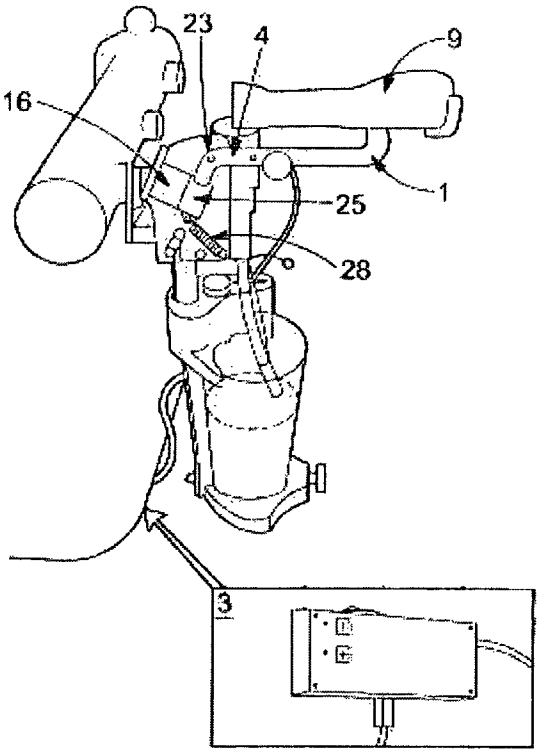
FIG. 3 is a side view with the tap in the 'on' position during filling of a glass with beer.
Figure 4A:
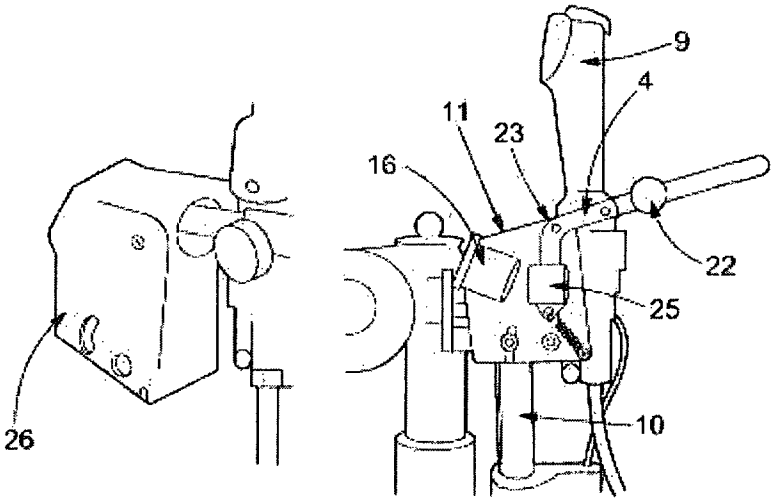
Figure 3A:
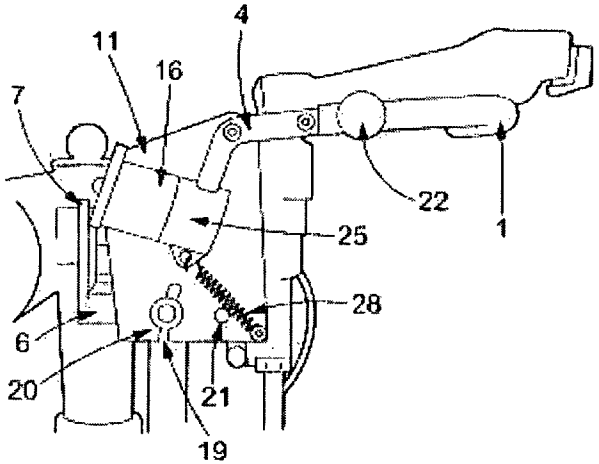
Figure 5:
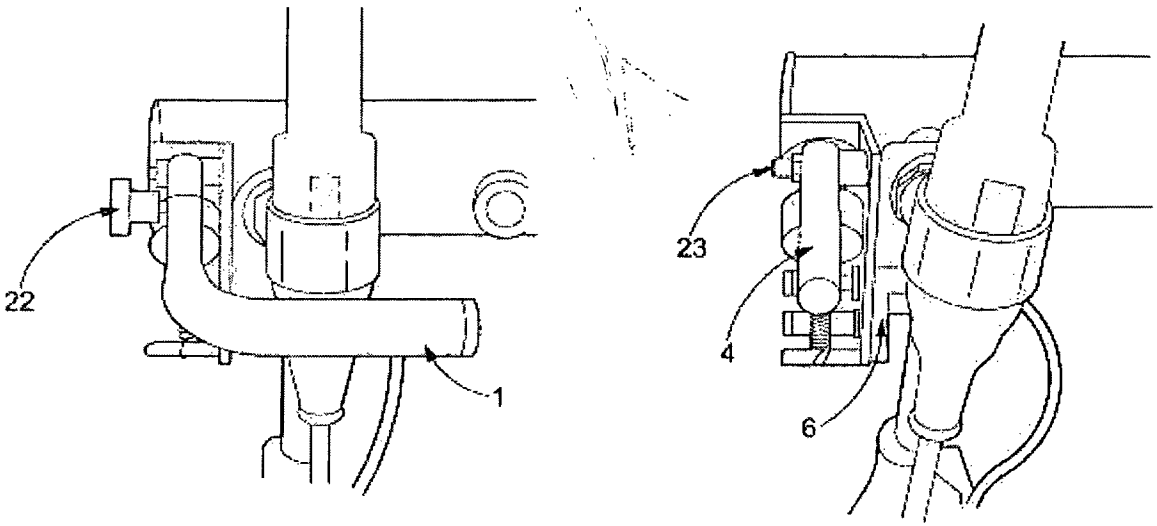
Figure 6:
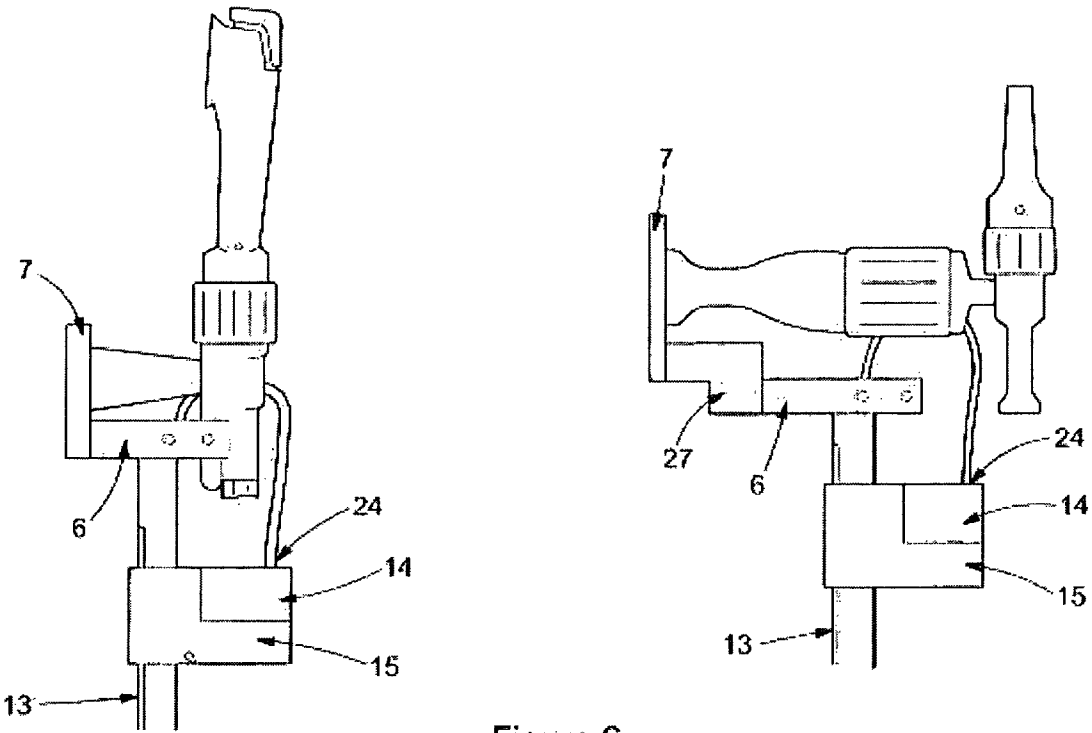
Figure 8:
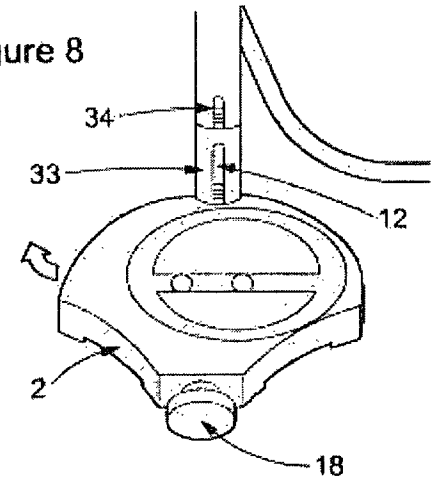
Figure 9:
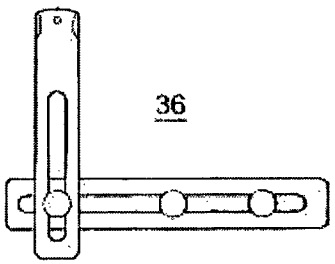
Figure 7:
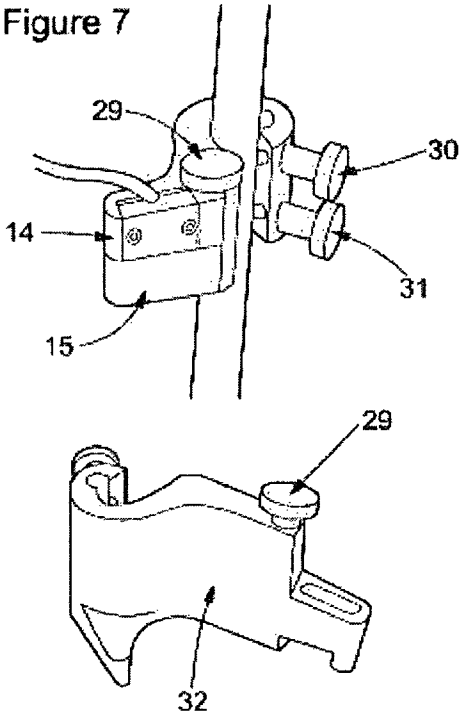
Figure 11:
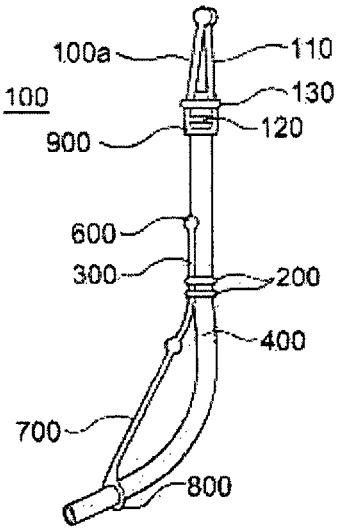
Figure 10:
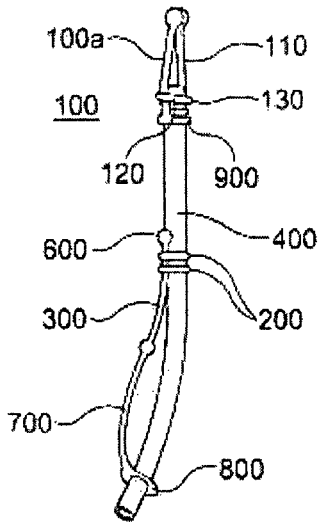
Figure 13:
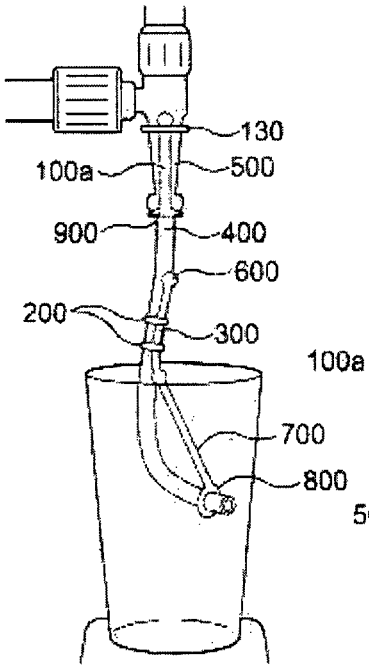
Figure 14:
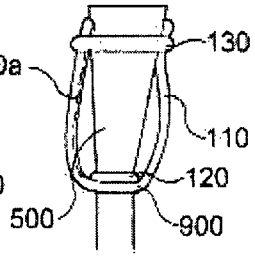
Figure 12:
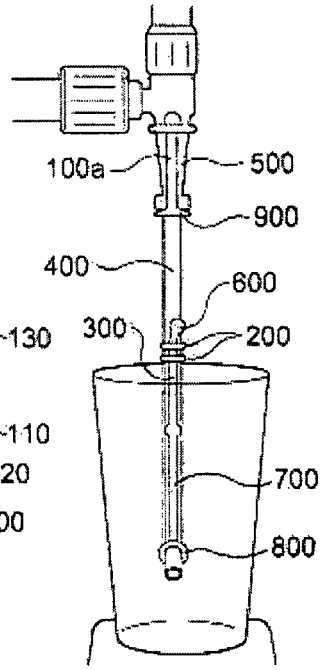

FIGS. 3*a* and 4*a* are enlarged side views with the tap in the same position as in FIGS. 3 and 4;

FIG. 5 is a front view of the device showing the manner in which the device can be decoupled to permit manual operation of the tap;

FIG. 6 illustrates different methods of fixing the device onto short and long taps;

FIG. 7 illustrates the detachable sensor housing attached to the device and a larger version of the sensor housing suitable for dispensing into pitchers;

FIG. 8 illustrates the detachable extension tube and variable height slot;

FIG. 9 illustrates the stability bracket that supports the vertical tube when the tube is to be certain fonts; and FIG. 10 illustrates the dispensing fitment under no tension from the adjuster cord;

FIG. 11 illustrates the dispensing fitment under tension from the adjuster cord;

FIG. 12 illustrates the dispensing fitment attached to a nozzle and under no tension in a glass;

FIG. 13 illustrates the dispensing fitment attached to a nozzle and under tension so that the tube is pressed against the side of the glass; and FIG. 14 is a closer view of the connection between the dispensing fitment and the tap nozzle.

Figure 1:
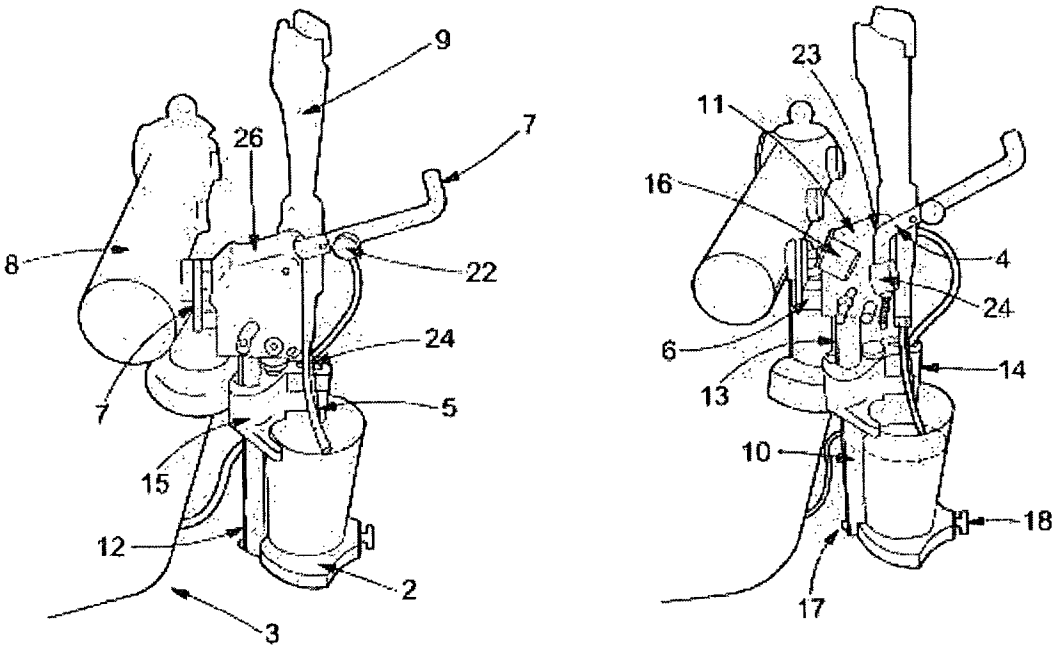
FIG. 1 is a side view of the device attached to a beer font.
Figure 2:
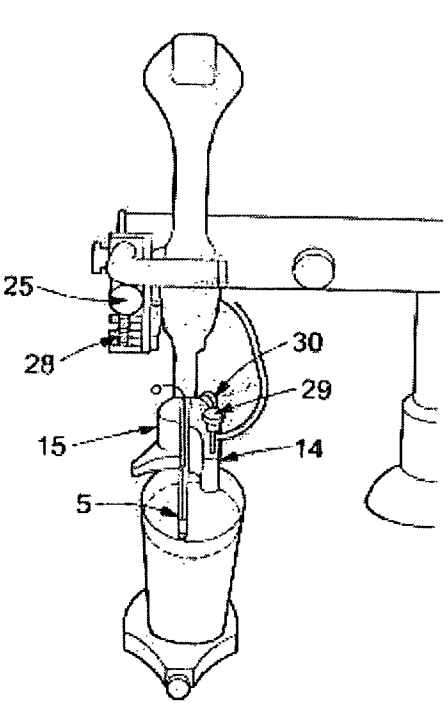
FIG. 2 is a front view of the device attached to a beer font.
Figure 2:
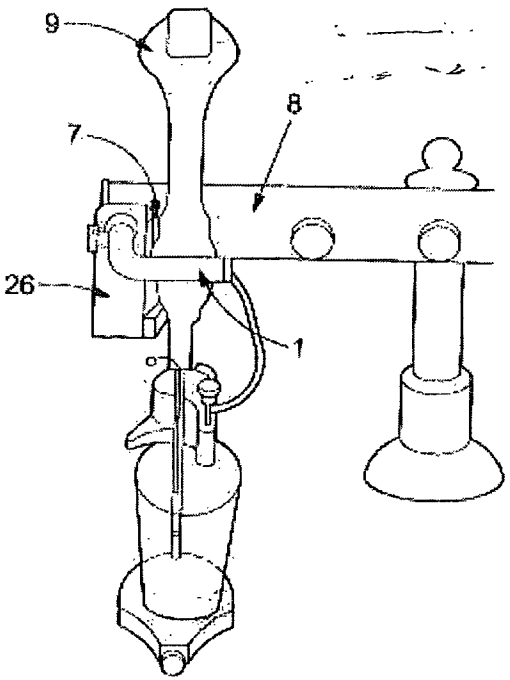

The illustrated embodiment of FIGS. 1 to 9 is a beer dispensing device designed for fitting to a conventional beer font using only three adjustments, thus making it quick to set up and allowing for flexibility in use. Referring to FIGS. 1 and 2, the dispensing device is attached between the tap 9 and font 8, and the connection is achieved with a 'hook on' fitment 7. By releasing a nut that secures the tap 9 to the font 8 a gap is created that allows the fitment 7 to rest on the threaded portion of the tap 9 used to mount the tap 9 onto the font 8, and, by retightening the nut, the tap 9 and font 8 are used to pinch lock the fitment 7, thus securing the device to the font 8 in the correct orientation, without having to disconnect the interior beer line. This makes the dispensing device easy to fit and suitable for attachment to the majority of available beer fonts. The dispensing device also has a pivot arm 1 that is adjustable to allow for use with a variety of taps. Thus the dispensing device can be used in a wide range of environments.

The illustrated dispensing device comprises a main block 6 fixedly connected to the fitment 7 and serving to support the other components of the device, including a vertical tube 10 which supports a glass platform 2, a swivel plate 11, a dispensing fitment 5 and cables leading to an electronic control circuit 3 which may incorporate a microprocessor. The vertical tube 10 supports a two part sensor component that can be moved along the vertical tube 10 as described in more detail below. The sensor comprises a sensor housing 14 and a sensor housing base 15. The sensor housing 14 is detachably attached to the sensor housing base 15 by attachment 29. This allows the sensor housing base 15 to be easily detached and cleaned as required. The detachable nature of the sensor housing base 15 allows the sensor housing 14 to be attached onto different designs of the sensor housing base 15. An example of a different sensor housing base suitable for dispensing into a pitcher is illustrated as component 32 in FIG. 7. The sensor has the necessary functionality to detect the level/amount of liquid in the glass as the liquid is being dispensed into the tap. The sensor may also be able to detect the amount of liquid in the glass by sensing the foam created as the liquid is dispensed into the glass, or use some other characteristic of the liquid that will enable the amount of the liquid in the glass to be determined.

The swivel plate 11 incorporates a pivot lever 4, a magnetiser 25, a spring 28, and an electromagnet 16, as may be seen in more detail in FIG. 4*a*. FIG. 3A illustrates the swivel plate 11 connected to a side of the main block 6 by two bolts 20 and 21. The components mounted on the swivel plate 11 are protected by a swivel plate cover 26 whilst allowing the pivot lever 4 and pivot arm 1 to move without interruption. The dispensing fitment 5 is attached to the beer nozzle of the tap and works to aid in the dispensing of the beer from the tap 9 into the glass or pitcher.

The main block 6 has an extension bracket 27 that allows for variation in the distance between the tap 9 and the font 8. Whilst the dispensing device includes a common main block 6, the provision of the extension bracket 27, enables the spacing between the font 8 and the tap 9 to be changed to allow the vertical tube 10 to be set in different positions, as shown in FIG. 6. When the main block 6 is fitted without the extension bracket 27, there is only a short distance between the font 8 and the tap 9, the extension bracket 27 provides an offset to allow for the bar fittings of font 8 if required to do so. The positioning of the vertical tube 10 is such that the sensor housing 14 sits adjacent to the beer tap. When the main block 6 is fitted with the extension block 27, the vertical tube 10 is set further forward allowing for a greater distance between the font 8 and tap 9 so that the sensor housing 14 is again positioned adjacent to the beer tap. The provision of the extension block 27 allows the device to be fitted to longer taps and to taps of larger diameter without interfering with any adjustment mechanisms that the tap may have. These components have the advantage of allowing for adjustment of the device so as to enable optimal positioning of the device in relation to different font and tap dimensions.

The vertical tube 10 further incorporates a orientation groove 13 that allows the sensor housing 14 and sensor housing base 15 to travel along the vertical tube 10 in the correct orientation. The sensor housing base 15 is releasably coupled to the vertical tube 10 using guide pins 30 and 31 situated on the sensor housing base 15. The sensor housing base 15 can be removed from the vertical tube 10 for cleaning as desired and the sensor housing placed into a slot on the cover 26 to protect the sensor. Guide pins 30 and 31 also reduce rotational movement of the sensor housing 14 and sensor housing base 15 and can be used to lock the sensor housing 14 and base 15 into a desired position.

The inside of the vertical tube 10 accommodates the electrical wires that run from the sensor housing 14 and the electromagnet 16 down to a 12 volt electrical control box 3 that is positioned away from the device for safety reasons.

The vertical tube 10 has an extension tube 33 which is coupled to the vertical tube 10 by a male threaded connection. Rotation of the extension tube 33 causes the tube 33 to move along the vertical tube and hence the displacement of the extension tube 33 with respect to the end of the vertical tube 10 can be varied. This is advantageous as the extension tube 33 is releasably coupled to a glass platform 2. Adjustment of the displacement of the extension tube 33 therefore causes a corresponding displacement of the glass platform 2, so as to account for the height of different glasses placed on the glass platform. The amount of displacement is limited to the length of the slot 12. The extension tube 33 can be detached from the vertical tube 10 if the length of the vertical tube 10 is adequate or the distance between the nozzle and drip tray does not allow for the extension tube 33 to be added. The end of the vertical tube 10 has a short slot 34 for the glass platform 2 to be attached if the extension tube 33 is not attached. If desirable, the glass platform 2 can be detached completely and the drip tray used if preferred. It will be appreciated that these features allow greater flexibility of the dispensing device with respect to the type of containers it can be used with. For example, the glass platform 2 can be set to a first height that is suitable for dispensing into pitchers placed on the drip trays; and then set back to its original height suitable for dispensing into glasses. However, the device would have to comprise a large sensor housing 32 so that the sensor is correctly positioned over the pitcher. As a large sensor housing can also be used with a glass, the device is adaptable for use with different containers without having to change the components of the dispensing fitment 5, which would otherwise slow down the dispensing process.

The glass platform 2 is double-sided with both sides recessed to appropriately place the glass underneath the tap and ensure that the dispensing fitment 5 dispenses correctly. The recesses formed in each side of the glass platform 2 correspond to two different glass diameters and the glass platform 2 can be turned through 180 degrees by the bar person according to the diameter of glass being dispensed into. Such an arrangement provides flexibility to cover a range of glass sizes whilst maintaining glass stability when positioned on the glass platform 2.

The glass platform 2 has a pinch fit locking mechanism 18 positioned at the front of the platform 2 for easy access. The locking mechanism 18 incorporates a threaded bar which extends through the glass platform 2 and locates into the slot 12 within the vertical tube 10, a lock nut 17 being attached to the end of the threaded bar located at the back of the slot 12. When tightened, the locking mechanism 18 pushes the platform 2 against the vertical tube 10 providing a pinch fit to secure the glass platform 2 in position.

The glass platform 2 can be easily removed by either loosening the locking mechanism 18 and sliding it off the end of the vertical tube 10 or extension tube 33 by undoing the locking mechanism 18 and pulling the glass platform 2 forward and away from the vertical tube 10. The threaded bar can also be removed for cleaning and then reinserted into the glass platform 2 to be kept safe.

The dispensing fitment 5 is provided to direct the beer into the glass at a required angle/height to avoid excessive foaming generated by the liquid being dispensed and is a disposable element made from a flexible material. The dispensing fitment 5 controls the quality of the beer in the glass whilst the beer is dispensed and acts as a virtual tilt of the glass under the tap, thus breaking the fall of the beer and improving quality of the dispensed beer. The dispensing fitment 5 may be changed and is attached with a push on fit onto the end of the beer nozzle. The dispensing fitment may incorporate an adjuster cord 35 which can be used to adjust and hold the angle of the tube. This adjustment of the dispensing fitment 5 allows for quality dispensing of the beer and overcomes the variable factors such as a changes in beer temperature and glass temperature that affect the quality of the dispensed beer.

The adjustability of the product at set up is further enhanced by the arrangement of the adjustable swivel plate 11, the adjustable pivot lever 4, and the main block 6 and allows for the dispensing device to work on a variety of fonts and taps. The swivel plate 11 has a slot 19, as shown in FIG. 3*a*, allowing it to rotate up and down around a bolt-hole 20 and to be locked into position by tightening of the locking bolt 21. This feature accommodates fixing of the device onto a variety of fonts and taps as it can be adjusted to line up with different diameters and lengths of taps. It works in conjunction with the pivot lever 4 and arm 1 that are telescopically coupled with a through lock 22, enabling the adjustment of the pivot lever arm 1 to be set at an optimum distance from the tap. These features allow the product to function efficiently with a wide range of fonts and taps. It will be appreciated that for tap and font arrangements that have a short distance between font and tap and a short tap handle, the pivot lever 4 and pivot arm 1 will have smaller dimensions than shown.

In order to increase the stability of vertical tube 10 when the fitment is used on certain fonts, an adjustable stability bracket 36 may be used to stabilise the vertical tube 10 (with or without extension tube 33), by securing the bottom of the vertical tube 10 to the stability bracket 36 and then attaching the bracket 36 to the bar or font. This will allow the product to be used on a wider variety of fonts.

The pivot lever 4 includes an L-shaped two part telescopic bar positioned on one side of the tap 9 and operates to pivot the tap 9 into its closed position when the dispensing of beer is to be stopped. A switching mechanism is provided to pivot the pivot lever 4 to turn the tap 9 off, and comprises a spring 28 connected between the pivot lever 4 and the swivel plate 11 acting to apply a spring force that rotates the pivot lever 4 around the pivot bar 23 that is mounted on the swivel plate 11 in the direction to turn the tap 9 off when the pivot lever 4 is released by the electromagnet 16.

The dispensing device also incorporates an electronic control circuit 3 for controlling the off function of the device. The electronic control circuit 3 includes a relay switch and is connected between a sensor 24 positioned in the sensor housing 14 and the electromagnet 16. Beginning with the device in the position shown in FIG. 4, beer is dispensed into the glass after manual operation of the tap 9 by the bartender. The bartender, by levering the tap 9 fully forward and down, causes the pivot arm 1 to move downwards, and in turn, the pivot lever 4 rotates so as to cause the magnetiser 25 to be engaged with the electromagnet 16. The pivot arm 1 is now locked into the dispensing position shown in FIG. 3, with the spring 28 being under tension. When the sensor 24 detects that the beer dispensed to the glass has reached the required level, a turn-off signal is supplied to the electronic control circuit 3 to cause the relay switch to switch off the holding current supplied to the electromagnet 16. This in turn releases the tension in the spring 28 and forces the pivot lever 4 to rotate around the pivot bar 23 with enough force to turn off the tap 9 automatically. The automatic turning off of the tap 9 at the correct moment minimises waste and reduces cleaning and emptying of the drip tray, as well as ensuring that the correct volume of beer is delivered. When the device has performed these functions it resets and is ready to be used repeatedly for controlling further dispensing operations.

Currently power is supplied to the electronic control box 3 by a 12 volts power transformer plugged into a mains socket. The transformer is connected to the electronic control box 3 that incorporates its own switch, supplying power to the device when required. If more than one dispensing device is required the electronic control box 3 can be connected to another control box for a further dispensing device by way of an adapter so that only one mains socket is necessary to power several devices. Power to the device can be switched off either independently by the switch on each electronic control circuit 3 or by switching power off at the mains socket.

The electrical wire that runs from the sensor housing 14 and the electromagnet 16 exits towards the bottom of the vertical tube 10 and feeds into the electronic control box 3 secured to the bar. This control box 3 houses the electrics to make the functionality possible and incorporates accessible buttons which allow adjustment of the sensor detection. This means that the distance which the sensor detects can be reduced or increased by pushing a corresponding button.

It is possible to contemplate variations of the illustrated device, such as changes in the shape of the frame and the positioning of the components. The electronic control circuit may be made more compact and the power supply changed to a sustainable power supply or some alternative. In an embodiment the electronic control box may include a microprocessor providing a number of further control functions, such as the ability to provide a readout of the number and/or frequency of dispensing operations performed by the device over a period of time, or other data related to the dispensed liquid. It may also have a memory in which to store the dispensing data so that it can analysed. The electronic control box may be arranged to transfer the dispensing data using a data cable to an external location. For example, the data can be retrieved by a computer device and transmitted to a remote location using a suitable communication network, or alternatively, the electronic control box may have sufficient functionality to transmit the data to a remote server over the Internet using a communication network such as a General Packet Radio Service (GPRS). Alternatively, the data related to the liquid dispensing may be processed by a separate device to the electronic control box, for example, a desktop computer.

The illustrated embodiment of FIGS. 10 to 14 is a dispensing fitment 100 for fitting to a conventional beer tap with a simple 'push on' fit.

In this embodiment the dispensing fitment 100 comprises a tube 400 made of a flexible material and is inserted into the end of a nozzle 500 of a beer tap, with a securing ring 900 providing the push fit with the nozzle 500. An anti-slip ring 130 is provided at the end of tubes 100*a*, 110 extending from the securing ring 900 and supports a ring 120 which has a friction fit with the tube 400. The securing ring 900 therefore securely holds the tube 400 to the nozzle 500 and the tubes 100*a*, 110 set the distance between the two securing rings 900, 130. A set of locking rings 200 are situated near the top of the dispensing fitment 100 and form a friction fit with an adjuster cord 300 that passes through the inside of the locking rings 200. The adjuster cord 300 is attached to an attachment ring 800 situated at the lower end of the tube 400, and passes through a tension release tube 700. However, the attachment ring 800 can be moved along the tube 400 to vary the position at which the adjustment cord is coupled to the tube 400.

The adjuster cord 300 can be pulled using the grip 600 and causes the dispensing fitment 100 to become curved as illustrated in FIGS. 11 and 13. The locking rings 200 act to press the adjuster cord 300 against the tube 400 with sufficient force to "lock" the tension in the adjuster cord 300. Pulling the tension release tube 700 in a downward direction releases the tension in the adjuster cord 300 and thereby straightens the tube 400 as illustrated in FIGS. 10 and 12. The maximum curvature of the tube 400 is controlled by the length of the tension release tube 700.

In use, the dispensing fitment 100 can be adjusted to increase the foaming generated by the liquid being dispensed by straightening the tube 400, as this causes the beer to be directed straight into the base of the glass and the beer hits the bottom of the glass at a maximum flow rate.

The amount of foaming generated by the liquid being dispensed is decreased by putting the adjuster cord 300 under tension using the grip 600. This causes the tube 400 to be pressed against the glass (as illustrated in FIG. 13) so that the beer is directed against, and along, the side of the glass. The flow rate of the bear is reduced due to friction acting occurring between the glass side and the beer, which in turn reduces the amount of foaming generated by the liquid being dispensed formed.

In alternative embodiments the dispensing fitment may be colour coded or customised to suit a particular font, dispensing liquid, or tap nozzle. The securing method may also be varied according to the design of the tap and nozzle to which it is to be attached. Furthermore, the dimensions of each component of the dispensing fitment can be sized according to the variations required to securely attach the dispensing fitment to different fonts and tap nozzles.

The skilled person will appreciate that a wide variety of alternative securing mechanisms can be used to secure the components of the dispensing fitment.

It will also be appreciated by the skilled person that the features of these embodiments can be combined and modified in a number of different ways without departing from the scope of the invention.

The invention claimed is:

1. A liquid dispensing device adapted to be removably coupled to an end of a beverage dispensing tap by a releasably securing dispensing fitment for appropriately directing a flow of liquid from the dispensing tap, the dispensing fitment comprising: an adjustment element a flexible tube for directing liquid therethrough, at least one securing ring for securing said flexible tube and said adjustable element to the dispensing tap an adjustment element operatively coupled to the flexible tube to place the flexible tube in a required direct position, and at least one locking element for holding the adjustment element in a position such that the flexible tube is held in a curved position in which liquid is dispensed from an end portion of the flexible tube in a required direction, the length of the non-elastic adjustment element being variable by locking a required length of the adjustment element relative to the flexible tube in order to vary different positions of the flexible tube.

* * * * *

UNITED STATES PATENT AND TRADEMARK OFFICE

CERTIFICATE OF CORRECTION

PATENT NO. : 8,869,847 B2
APPLICATION NO. : 12/518726
DATED : October 28, 2014
INVENTOR(S) : Browne-Wilkinson It is certified that error appears in the above-identified patent and that said Letters Patent is hereby corrected as shown below:

In the Claims

Column 9, claim 1, should read;

Line 25: at least one locking element for holding an adjustment
Line 26: element in the required directed position such that the flexible tube is held in
Line 27: the required directed position in which liquid is dispensed from an
Line 28: end portion of the flexible tube in required direction,
Line 29: the length of the adjustment element being
Line 30: variable to lock a required length of the adjustment
Line 31: element relative to the flexible tube in order to obtain
Line 32: the required directed position of the flexible tube.

Signed and Sealed this
Thirteenth Day of January, 2015

Michelle K. Lee

Michelle K. Lee
*Deputy Director of the United States Patent and Trademark Office*